US005506005A

United States Patent [19]

Paloviita

[11] Patent Number: 5,506,005

[45] Date of Patent: Apr. 9, 1996

[54] METHOD AND ASSEMBLY FOR PREVENTING AIR ENTRY BETWEEN A MOVING MATERIAL WEB AND A ROLL

[75] Inventor: Petri Paloviita, Vantaa, Finland

[73] Assignee: Valmet Corporation, Helsinki, Finland

[21] Appl. No.: 178,872

[22] Filed: Jan. 7, 1994

[30] Foreign Application Priority Data

Jan. 13, 1993 [FI] Finland ..... 930126

[51] Int. Cl.[6] ..... B05D 1/28

[52] U.S. Cl. ..... 427/428; 118/62; 118/68; 118/244; 118/246; 118/249; 118/253

[58] Field of Search ..... 118/62, 68, 244, 118/246, 249, 253; 427/428

[56] References Cited

U.S. PATENT DOCUMENTS

| | | | |
|---|---|---|---|
| 3,468,700 | 9/1969 | Long | 118/249 |
| 3,539,384 | 11/1970 | Kolesinskas | 118/249 |
| 3,929,097 | 12/1975 | Kanda et al. | 118/246 |
| 5,340,611 | 8/1994 | Kustermann et al. | 427/428 |

FOREIGN PATENT DOCUMENTS

| | | |
|---|---|---|
| 50264 | 2/1970 | Finland . |
| 3757/71 | 12/1971 | Finland . |

*Primary Examiner*—Shrive Beck
*Assistant Examiner*—David M. Maiorana
*Attorney, Agent, or Firm*—Cohen, Pontani, Lieberman, Pavane

[57] ABSTRACT

Investigations have shown that curtailing the entry of air between the coater backing roll (3) and the web (5) being coated can offer a significant reduction in the number of uncoated blotches. By virtue of preventing the occurrence of such coat defects, the rotational speed of the kiss roll (2) in kiss roll coaters can be reduced. The invention is based on pressing the web (5) being coated against the backing roll (3) from the opposite side of the web (5) relative to the backing roll (3) at a point preceding the nip between the kiss roll (2) and the backing roll (3), whereby air is prevented from entering between the web (5) and the backing roll (3). The means employed for pressing the web (5) against the backing roll (3) is an air jet to avoid imposing additional stress on the web.

17 Claims, 2 Drawing Sheets

METHOD AND ASSEMBLY FOR PREVENTING AIR ENTRY BETWEEN A MOVING MATERIAL WEB AND A ROLL

BACKGROUND OF THE INVENTION

The present invention relates to a method and apparatus for preventing air conveyed by a moving material web from entering between a backing roll of a coater and said web.

The number of different defects in paper web coating increases rapidly with the increase of web speed in the coater. Consequently, when the web speed is increased, equipment and methods must be developed to be capable of maintaining a high coat quality, even at the high web speeds today requested above those used in the prior art. For example, coat application in a kissing roll coater encounters a defect type called skipping, which means mottled coating caused by uncoated blotches occurring on the coated web. In kiss roll coaters, the coating mix is applied by means of a kiss roll rotating in a coat mix tray onto the paper web passing over the backing roll and the coat is subsequently smoothed by means of a doctor blade. Tests performed indicate that one factor causing skipping is air entering between the web and the backing roll. The kiss roll is ordinarily rotated along with the web at a tangential speed of approx. 10–30% the speed of the web being coated. Alternatively, the kiss roll can be rotated counter to the web movement or at a different speed, whereby similar problems are met also in these cases. Air conveyed into the tapering space between the roll and the web causes equivalent complications in other application methods, too.

When the web speed is increased, the rotational speed of the kiss roll must be increased by an equivalent measure to avoid the occurrence of uncoated blotches. On the other hand, when the rotational speed of the kiss roll is increased, more splashing of the coat mix will occur, and eventually streaking of the coat, whereby the equipment and surroundings are soiled and paper quality deteriorated. Accordingly, a sufficiently low rotational speed of the kiss roll should be used that still can provide a coat of satisfactory quality. At maximum web speeds the rotational speed of the kiss roll unavoidably becomes so high as to cause splashing to a relatively high extent. Then, the rotational speed of the kiss roll need be reduced, which has not been possible in prior-art equipment due to the concomitant increase of coating defects.

Tests performed by the applicant have shown that the occurrence of uncoated blotches can be substantially lessened by reducing the amount of air entering between the coater backing roll and the web being coated. If the occurrence of coating defects can be prevented, a reduction of the kiss roll rotational speed in kiss roll coating methods becomes possible.

It is an object of the present invention to provide a method and an assembly suited for curtailing air entry between the coater backing roll and the web being coated.

SUMMARY OF THE INVENTION

The invention is based on pressing the web being coated against the backing roll from the opposite side of the web relative to the backing roll at a point preceding the nip between the kiss roll and the backing roll, whereby air is prevented from entering between the web and the backing roll.

The principal benefits of the invention are the quality improvement of coated paper and reduction of coating defects in most application methods. The rotational speed of the kiss roll can be reduced, whereby also the splashing of the coat mix is reduced, or alternatively, the web speed can be increased while still retaining the quality level unchanged. The assembly required is simple and easy to manufacture, and its retrofit compatibility with conventional coaters is good. The pressing of the web against the backing roll imposes no significant stress on the paper web thus causing no deterioration of the paper web properties, since the pressing operation can be arranged in a noncontacting manner. Additionally, the pressing means doctors away air conveyed by the web into the application nip or slit, thus equalizing the application conditions in the nip with a resulting improvement of the coat quality.

BRIEF DESCRIPTION OF THE DRAWINGS

In the following the invention is described in greater detail with the help of the accompanying drawings in which.

DETAILED DESCRIPTION OF THE INVENTION

Figure 1:
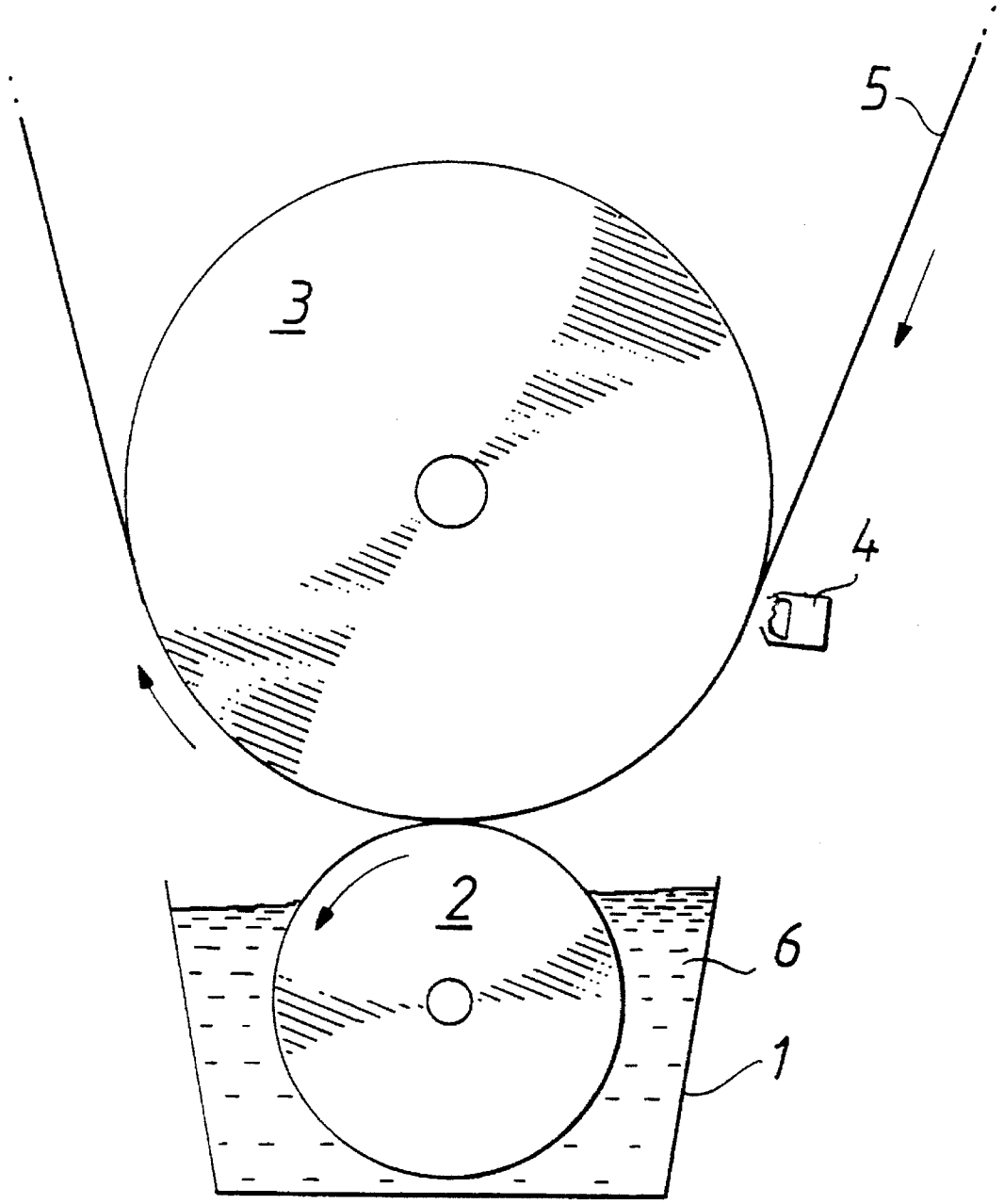
FIG. 1 shows diagrammatically one embodiment of the invention.

With reference to FIG. 1, the application of the coat mix by means of a kiss roll is shown in a diagrammatic manner. In such a coater a web 5 being coated is routed over a backing roll 3 so as to cover slightly less than half the circumference of the backing roll 3. Located approximately to the midpoint of the arc covered by the web 5 over the backing roll 3 is a kiss roll 2 so as to form with the backing roll 3 an application nip through which the web 5 being coated passes. The kiss roll 2 is placed in a tray 1 containing so much coat mix 6 as to leave the nip of the roll 2 clearly above the coat mix level. The movement directions of the backing roll 3, the kiss roll 2 and the web 5 are indicated by arrows in the diagram.

In the embodiment described herein, the entry of air between the backing roll 3 and the web 5 is prevented by means of a blow pipe 4. The pipe 4 is extended over the entire web width and has a slit nozzle mounted to it in the cross direction of the web, said pipe being mounted at the tangential meeting point of the web 5 with the backing roll 3 on the entry side of the web 5 relative to the kiss roll 2 in a manner described below in greater detail.

The coating operation with the help of the above-described assembly is as follows. The web 5 meets first the backing roll 3 and the web is pressed by means of the air jet blown via the nozzle slit of the blow pipe 4 against the backing roll 3, thus preventing the air conveyed by the web 5 from entering between the web 5 and the backing roll 3. An appropriate gauge pressure at the meeting point of the web 5 with the backing roll 3 is approx. 2.5 kPa, whereby the entry of air under the web 5 is prevented at contemporary web speeds. The applied pressure is selected so as to make the imposed force sufficiently high to attain the desired effect of preventing the entry of the conveyed air between the web and the backing roll.

Next, after passing the blow pipe 4, the web 5 meets the kiss roll 2 whose rotation lifts coating mix 6 from the tray 1 to the nip between the web 5 and the kiss roll 2, and a portion of the mix is applied to the surface of the web 5 in the nip. Subsequently, the web 5 meets a doctor blade which is not shown here, since the doctor blade arrangements of a kiss roll coater are well known in the art.

Figure 2:
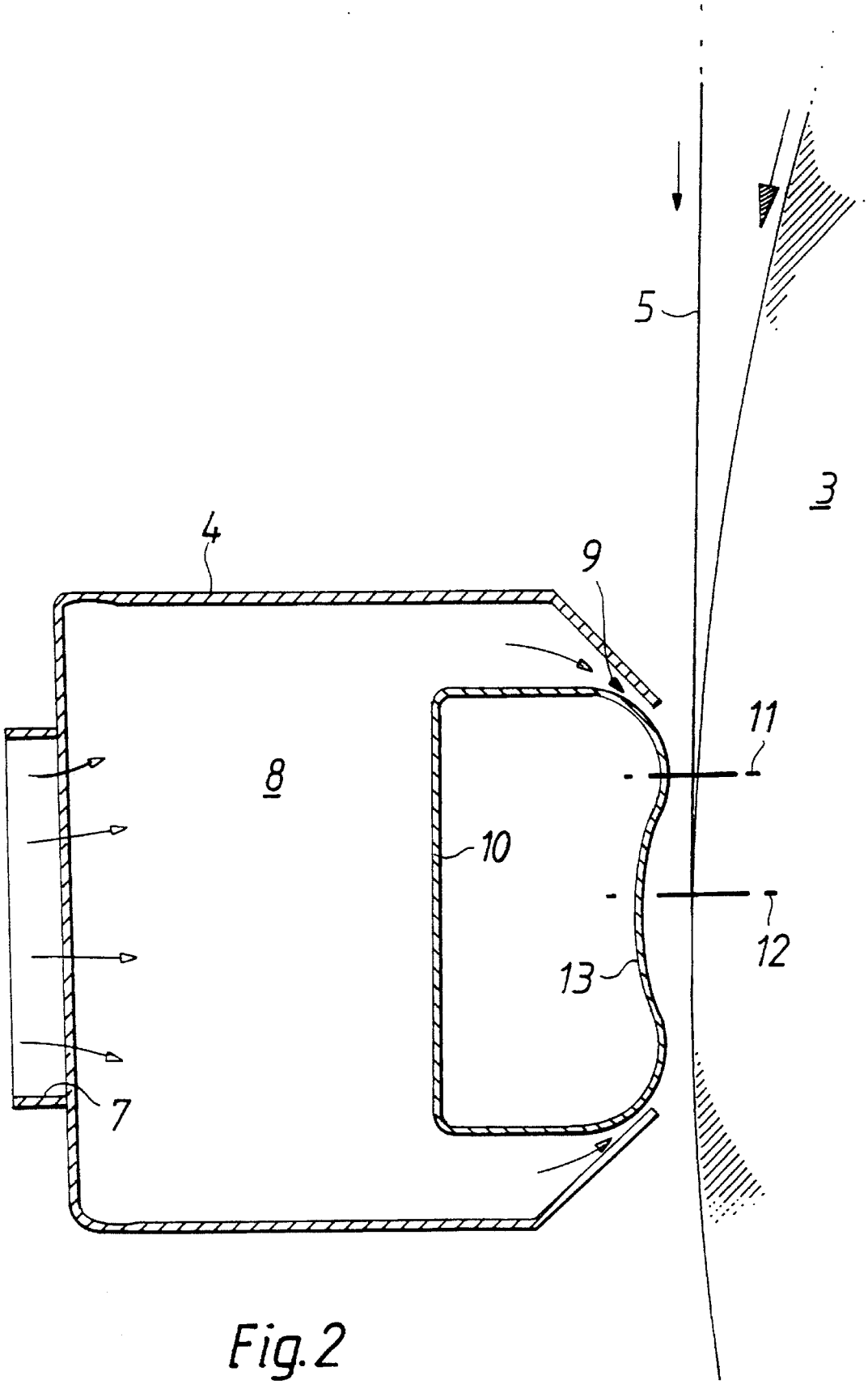
FIG. 2 shows an enlarged view of the embodiment depicted in FIG. 1.

With reference to FIG. 2, the construction of the blow pipe 4 and its position relative to the backing roll 3 and the web 5 is shown in greater detail. The blow pipe 4 is comprised of a U-shaped section extending at least essentially across the web 5, said section having the edges of the U-shape slightly inward slanted. The inside space of the section forms an air compartment 8 into which an inlet air nozzle 7 exits. Adapted to the exit slit of the U-shaped section is a tubular flow guide 10 which blocks the exit slit almost entirely so as to leave only a narrow nozzle slit 9 between the perimeter of the tubular flow guide and either inward slanted edge of the section. The nozzle slit 9 is thus formed at either edge of the blow pipe 4 and said slits 9 direct the exiting air jets against each other toward the center plane 12 of the blow pipe 4. The perimeter of the tubular flow guide 10 facing the web 5 is curved so that its edges reach closer to the web 5, while its center is retracted from the web so as to form a groove 13. The purpose of the above-described contouring of the tubular flow guide 10 is to align the pressure effect of the air jets toward the center plane 12 of the blow pipe and to maximize the imposed pressure effect.

The blow pipe 4 is placed at the meeting point of the web with the backing roll 3 so that the center plane 12 of the blow pipe, which determines the location where the pressure effect is applied, is situated next after the meeting point 11 of the web 5 with the roll 3 as viewed from the entry direction of the web 5 onto the roll. According to the results of conducted tests, an advantageous displacement of the center plane 12 from the meeting point 11 is 8–12 mm, most advantageously 10 mm. The optimal placement of the blow pipe is dependent on the size of the backing roll 3, the web speed and other related factors, whereby the mounting of the blow pipe 4 is preferably arranged by adjustable means, thus allowing the optimization of the blow pipe placement through practical test runs.

Besides those described above, the present invention can have alternative embodiments. Obviously, the shape of the outlet nozzle and the construction of the blow pipe can be varied in multiple ways. The outlet nozzle can simply be a single slit exiting against the web, or alternatively, complemented by guide surfaces similar to the tubular flow guide used in the above-described embodiment with the purpose of further augmentation and alignment of the effect imposed by the exiting air jet. If the exit nozzle is tilted backward counter to the web travel in the machine direction, the jet performs an effective doctoring-away of the air conveyed by the web. However, the exit nozzle should not be tilted too obliquely against the machine direction of the web, because an air jet directed to a sufficiently small angle against the web travel evokes a partial vacuum that detaches the web from the surface of the backing roll. The design of the exit nozzle shape should aim at reaching maximum imposed pressure effect with the least volume rate of blow air. The exit nozzle can have a discontinuous construction in the web cross direction.

Replacing the compressed air in pressing the web, a mechanical knife or similar pressure-applying means can be used. However, such means impose additional stress on the web, so they must preferably be made of low-friction materials such as plastics or ceramics. The use of a mechanical embodiment attains accurate alignment of the position at which the pressure is imposed on the web and no compressed air jets are discharged to the surroundings. The combination of a mechanical means with air blowing is also feasible, and further, the use of a greater number of pressing means is conceivable, for instance, two pressing means displaced at a distance from each other.

Obviously, the present invention is also suited for use in conjunction with other coating methods than the above-described coat application by means of a kiss roll.

I claim:

1. A method for preventing entry of air between a moving web and a backing roll of a coating station during the coating of said web, comprising:

passing said web through a nip defined between said backing roll and means for applying a coating to a desired surface of said web, said web being in contact with a circumferential surface portion of said backing roll extending at least between an initial tangential meeting line and said nip;

pressing said web against said backing roll by applying pressure to said desired surface of said web along a line transverse to said web and disposed between said tangential meeting line and said nip; and applying a coating to said desired surface of said web.

2. A method as defined in claim 1, wherein said transverse line is situated at a distance of less than 12 mm from the tangential meeting line.

3. A method as defined in claim 1, wherein said transverse line is situated at a distance of 8 to 12 mm from the tangential meeting line.

4. A method as defined in claim 1, wherein said pressing step comprises directing an air jet at said web along said transverse line.

5. A method as defined in claim 1, wherein said pressing step includes exerting pressure against said web with a mechanical pressing means.

6. A method as defined in claim 4, wherein the pressure of the air jet directed toward the web during said pressing step is at least 2.5 kPa.

7. A method as defined in claim 4 wherein the air jet directed toward the web (5) is disposed in an oblique plane relative to a surface of said web proximate said transverse line.

8. An apparatus for coating a material web comprising:

support means for supporting a first surface of said web along an arcuate path, said arcuate path beginning at an initial tangential meeting line;

application means for applying a coating to a second surface of said web, said application means being disposed proximate said support means and contacting said second surface along a portion of said arcuate path; and pressing means for applying pressure to said second surface of said web to press said web against said support means along a line transverse to said arcuate path, said line being disposed between said initial tangential meeting line and said arcuate path portion.

9. The apparatus of claim 8, wherein said support means is a backing roll and said arcuate path covers a portion of the circumference of said backing roll.

10. The apparatus of claim 8, wherein said transverse line is situated at a distance of less than 12 mm from said tangential meeting line.

11. The apparatus of claim 8, wherein said transverse line is situated at a distance of 8 to 12 mm from the tangential meeting line.

12. The apparatus of claim 8, wherein said pressing means comprises a blow pipe having an air exit nozzle.

13. The apparatus of claim 12, wherein said exit nozzle comprises a slit extending in a direction transverse to said arcuate path.

14. The apparatus of claim 12, wherein said blow pipe comprises a body having a substantially U-shaped cross section and opposed, inwardly directed edges at a distal end thereof defining a slit therebetween.

15. The apparatus of claim 14, wherein said blow pipe further comprises a flow guide disposed with said body and positioned proximate said inwardly directed edges to define narrow exit slits therebetween.

16. The apparatus of claim 15, wherein said flow guide defines a recessed external surface disposed between said inwardly directed edges.

17. The apparatus of claim 16, wherein said recess is dimensioned and arranged to align air pressure exerted by said exit slits toward said transverse line.

* * * * *